US005685290A

United States Patent [19]

Collins et al.

[11] Patent Number: 5,685,290

[45] Date of Patent: Nov. 11, 1997

[54] COMBUSTION AIR KIT

[75] Inventors: P. Michael Collins, 3790 Sagebrush La., Cincinnati, Ohio 45251; Alfred J. Berger, Jr., Cincinnati, Ohio

[73] Assignee: P. Michael Collins, Cincinnati, Ohio

[21] Appl. No.: 699,589

[22] Filed: Aug. 19, 1996

[51] Int. Cl.[6] ..... F24B 1/189

[52] U.S. Cl. ..... 126/518; 126/515; 126/318; 454/274; 454/276

[58] Field of Search ..... 126/518, 515, 126/516, 314–319, 307 R, 85 B; 454/274, 276, 334

[56] References Cited

U.S. PATENT DOCUMENTS

| | | | |
|---|---|---|---|
| D. 32,136 | 1/1900 | Marshall . | |
| 42,804 | 5/1864 | Stoner . | |
| 47,569 | 5/1865 | Richardson . | |
| D. 183,597 | 9/1958 | Clark . | |
| 240,035 | 4/1881 | Merrick . | |
| D. 258,386 | 2/1981 | Juett . | |
| 848,917 | 4/1907 | Mc Elligott et al. | 454/274 |
| 856,926 | 6/1907 | Stevick | 454/274 |
| 948,007 | 2/1910 | Doane . | |
| 978,227 | 12/1910 | Sholar . | |
| 995,020 | 6/1911 | Mansell | 126/318 |
| 996,447 | 6/1911 | Armstrong | 126/319 |
| 1,313,085 | 8/1919 | Greene . | |
| 1,389,516 | 8/1921 | Killen . | |
| 1,430,781 | 10/1922 | Ackroyd . | |
| 1,469,494 | 10/1923 | Buckler . | |
| 1,529,183 | 3/1925 | Howren . | |
| 1,806,793 | 5/1931 | Dobie . | |
| 2,278,189 | 3/1942 | Barnes . | |
| 2,303,559 | 12/1942 | Kinney . | |
| 2,350,771 | 6/1944 | Klunder | 454/276 |
| 2,390,995 | 12/1945 | Foltz . | |
| 2,772,622 | 12/1956 | Slower | 454/276 |
| 3,220,715 | 11/1965 | Kinney . | |
| 3,257,929 | 6/1966 | Kortvely . | |
| 3,538,909 | 11/1970 | Migues et al. . | |
| 4,016,859 | 4/1977 | Landowski . | |
| 4,184,474 | 1/1980 | Pulliam et al. . | |
| 4,216,761 | 8/1980 | Stegmeier . | |
| 4,248,206 | 2/1981 | Orthey, Jr. . | |
| 4,249,510 | 2/1981 | Anderson . | |
| 4,267,818 | 5/1981 | Taylor . | |
| 4,280,474 | 7/1981 | Ruegg, Sr. . | |
| 4,320,612 | 3/1982 | Jeffreis, Jr. . | |
| 4,372,288 | 2/1983 | Nicholas . | |
| 4,374,515 | 2/1983 | Conrad . | |
| 4,407,264 | 10/1983 | Pettorino . | |
| 4,446,847 | 5/1984 | Martin . | |
| 4,532,915 | 8/1985 | de Rham . | |
| 4,723,533 | 2/1988 | Cover . | |
| 4,819,613 | 4/1989 | McDonald et al. . | |
| 4,825,849 | 5/1989 | Armour . | |
| 4,964,396 | 10/1990 | Crum . | |
| 5,423,152 | 6/1995 | Kolvek . | |

FOREIGN PATENT DOCUMENTS

| | | |
|---|---|---|
| 637910 | 2/1981 | United Kingdom . |

*Primary Examiner*—James C. Yeung

*Attorney, Agent, or Firm*—Wood, Herron and Evans, L.L.P.

[57] ABSTRACT

A combustion air kit for providing a source of external air to feed a fire in a firebox is installed during new construction or as a retrofit unit into existing fireplaces. A masonry air vent brick having a hole therein air flow is included in the combustion air kit. The flow of air through the brick and to the firebox is regulated by a spinner cap mounted for rotation on a threaded post seated within a plug contained in the air vent brick. The air vent brick is connected to a flexible duct which is attached at an opposite end to a vent inlet brick located on the external of the house, chimney or other structure. The vent inlet also includes a vent inlet cover to provide an attractive inlet for the air to the firebox.

4 Claims, 3 Drawing Sheets

COMBUSTION AIR KIT

BACKGROUND OF THE INVENTION

This invention relates to fireplaces, and more particularly to a combustion air kit for supplying air from outside the building structure to a fire within a firebox in the fireplace.

Open hearth fireplaces are extremely popular in residential construction. However, such fireplaces can be very inefficient as a source of heat for the house. This is primarily due to the fact that the fire contained within the firebox of the fireplace typically draws air from within the room in which the fireplace is located. As a result, the warm air within the room is pulled into the fire and exhausted upwardly through the flu and chimney.

One solution to this problem has been to provide a draft or damper for the firebox of the fireplace which draws air from the exterior of the room or building into the fire. With such devices, the cool exterior air may be drawn into the fireplace to support combustion rather than allowing the fire to draw the warmer air from within the room. Devices of this type allow for the heat from the fire to radiate into the air which is retained within the room and the heated air therefore will permeate the room atmosphere and spread to other rooms.

Unfortunately, a great number of existing fireplaces have been constructed without such outside air supply devices. There is a growing recognition that existing fireplaces would greatly benefit from efficiency improving modification. However, since many fireplaces are masonry or brick structures, they tend to be permanent and thus difficult or expensive to modify.

Fresh air vents of the type described typically must be installed during construction of the fireplace which is carried out by the bricklayer or stonemason as required by local building codes.

Therefore, problems associated with improving existing fireplaces with outside air ducts and for the construction of new fireplaces equipped with outside air ducts center around the ability of the bricklayer or stonemason to effectively and efficiently install a sturdy, durable and effective combustion air kit.

SUMMARY OF THE INVENTION

It has therefore been a primary objective of this invention to provide an improved air draft system for feeding air from an external source to the firebox of a fireplace, It has been a further objective to provide such a system which can be easily installed in new construction homes or retrofit for use into existing fireplace structures.

It has been a still further objective to provide such a system which includes durable and heavy duty components that can be easily installed by a bricklayer or stonemason during the construction or renovation of a fireplace.

A still further objective of this invention has been to provide such a system which includes components that are readily compatible with standard brick sizes and can readily accommodate variations in those sizes durring installation, These and other objectives of the invention have been attained by a combustion air kit which provides outside or external air to the firebox of a fireplace for combustion in the fire. The components of the kit can be incorporated into the fireplace during the initial construction thereof or can be added to an existing fireplace as a retrofit unit by removing the appropriate bricks and replacing them with the corresponding components of the combustion air kit.

One component of the combustion air kit according to a presently preferred embodiment of the invention is a masonry air vent brick which is built into or added to the wall of the masonry firebox or an adjacent wall structure in communication with the firebox, The air vent brick consists of a standard fire brick with the addition of a hole therein. The air vent brick is sized the same as a standard fire brick or integral number of standard fire bricks so that it can be easily incorporated into the firebox as the courses of brick are being constructed by the bricklayer or stonemason and as such offers a time saving advantage during installation.

The air vent brick, according to one presently preferred embodiment, includes a center plug connected to one or more webs extending outwardly from the plug in the central hole. A threaded post is seated within the plug and a threaded spinner cap is mounted on the post. When the air vent is placed in the back or side face of the firebox or in an adjacent wall in communication with the firebox, the threaded spinner cap is rotated to open or close the air vent and thereby regulate the flow of outside air through the air vent brick hole and to the firebox.

It will be appreciated that the air vent brick and associated adjustable damper or spinner cap can be adjusted to vary or regulate the amount of external air being admitted to the firebox of the fireplace. A high temperature gasket is preferably provided between the threaded spinner cap and the face of the air vent brick to provide a seal.

A flexible duct is mounted to the back face of the air vent brick and extends to a vent inlet brick located on the exterior of the building or structure such as the chimney or the like. The flexible duct is connected to a hole in the vent inlet brick which consists primarily of a brick having a central hole therein. The duct provides an unobstructed air flow for outside or external air to the firebox of the fireplace for combustion. The vent inlet brick is sized in a presently preferred embodiment to fit in two modular brick courses and has the length of a standard brick so that it can be easily incorporated into the courses of brick forming the chimney. Since the vent inlet brick and the air vent brick are each sized the same as an integral number of bricks forming the respective wails into which the bricks are incorporated, the kit of this system can be easily installed by a bricklayer or stonemason during the initial construction of the fireplace. Similarly, the appropriate number of bricks can be easily removed from an existing fireplace or wall so that the vent inlet brick and air vent bricks can be inserted into the existing structure with a minimum amount of destruction and reconstruction. A metal screen is seated within the hole vent in the inlet brick to prevent animals or other unwanted debris from entering the duct and the firebox.

The presently preferred embodiment of the invention further includes an vent inlet cover which is located on the exterior wall of the chimney building or the like. The cover protects the vent inlet on the exterior of the building and has an upper flange and a downwardly depending shield. The upper flange of the cover is seated on the top of the vent inlet brick and below the course of bricks immediately thereabove. The cover is secured in place preferably by the mortar between the vent inlet brick and the immediately superadjacent course of bricks.

Tabs depend downwardly from a back edge of the upper flange and are bent around the vent inlet brick. Because the bricks are not always manufactured to exacting tolerances, the upper flange and the bendable tabs accommodate variations in the size or thickness of the vent inlet brick. As such, the vent inlet cover can easily and securely be incorporated into the construction or renovation of the chimney and provide an attractive and functional cover for the vent inlet. In an alternative embodiment, the vent inlet cover can be used in non-masonry exterior walls such as those having siding or lap board facades.

Therefore, the present invention including the masonry air vent brick and associated adjustable damper or spinner cap, the vent inlet brick, the vent inlet cover and other components of the combustion air kit according to this invention provide a practical solution for feeding the firebox of a fireplace with external air. Further, the components of this invention can be easily incorporated into new construction of the fireplace by the bricklayer or stonemason or can be readily retrofit into an existing fireplace as described.

BRIEF DESCRIPTION OF THE DRAWINGS

The objectives and features of the invention will become more readily apparent from the following detailed description taken in conjunction with the accompanying drawings in which.

DETAILED DESCRIPTION OF THE INVENTION

Figure 1:
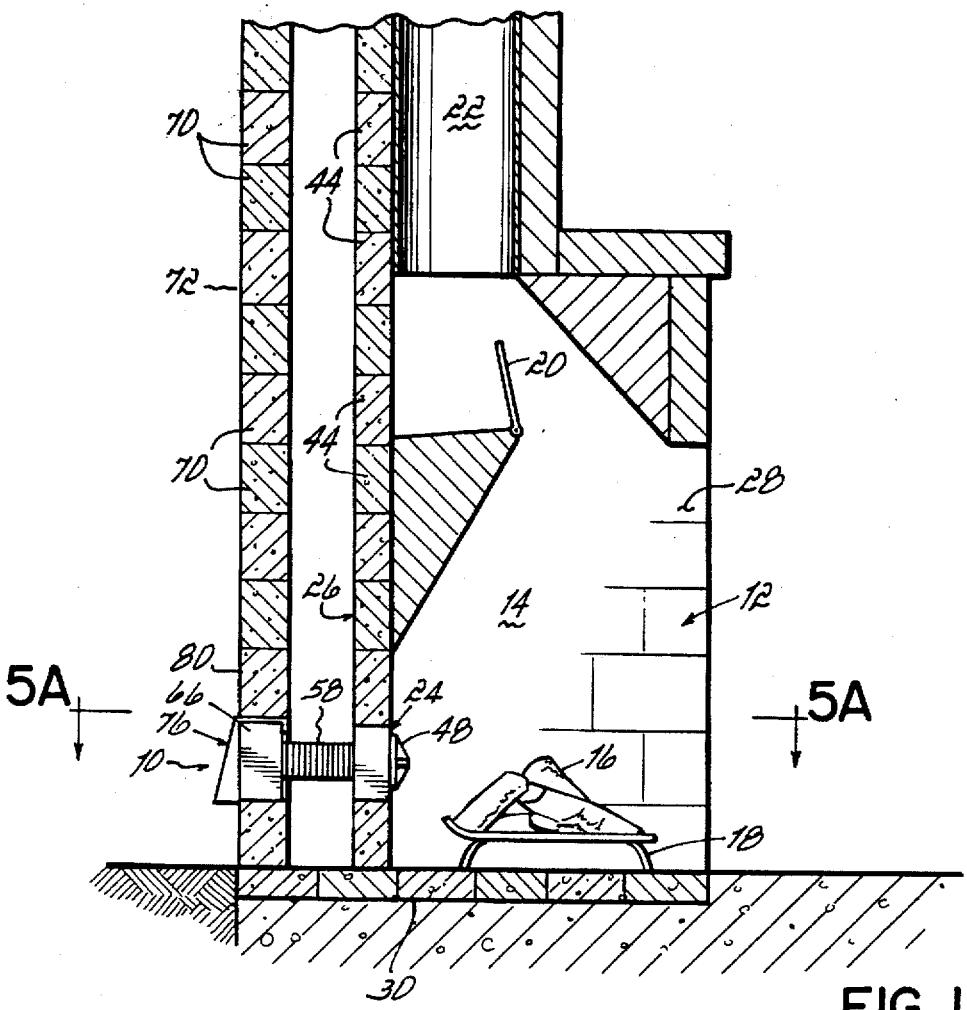
FIG. 1 is a cross-sectional view of a presently preferred embodiment of a combustion air kit according to this invention incorporated into the masonry firebox and masonry external wall of a building.

A combustion air kit 10 according to a presently preferred embodiment of the invention is shown in FIG. 1 installed in a typical residential fireplace 12. The fireplace 12 of FIG. 1 includes a masonry firebox 14 in which logs 16 are supported by a grate 18 for combustion or burning in the firebox 14. A pivotal flue 20 is located at the top of the firebox 14 for opening or closing access to a chimney 22 through which smoke and other by-products of the burning logs 16 exit the firebox 14.

Figure 3:
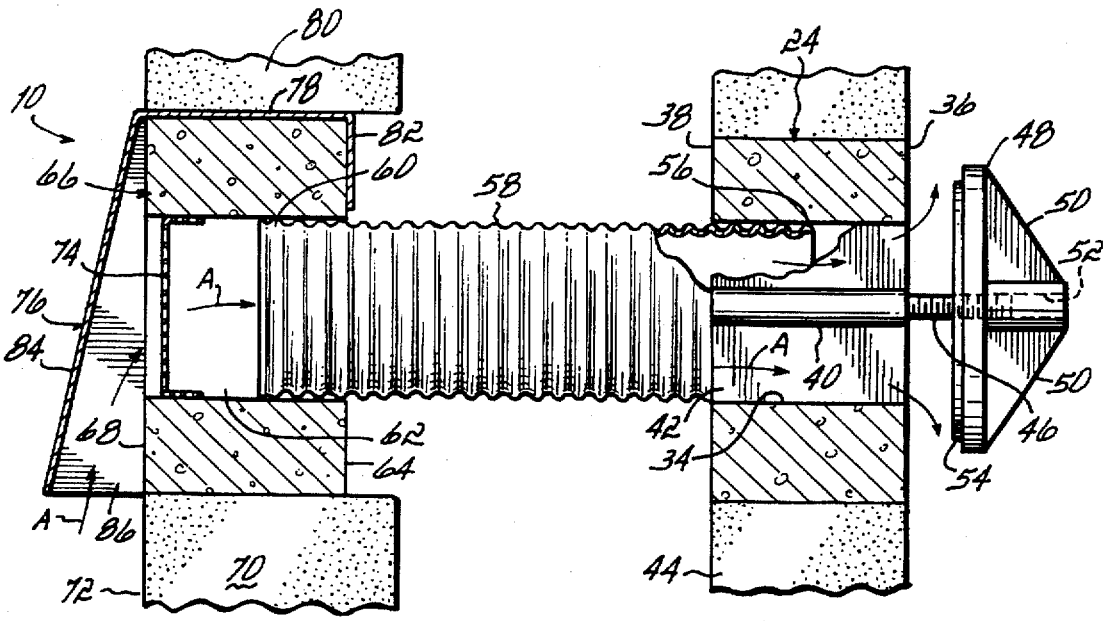
FIG. 3 is a cross-sectional view taken along line 3—3 of the assembled components of FIG. 2.
Figure 2:
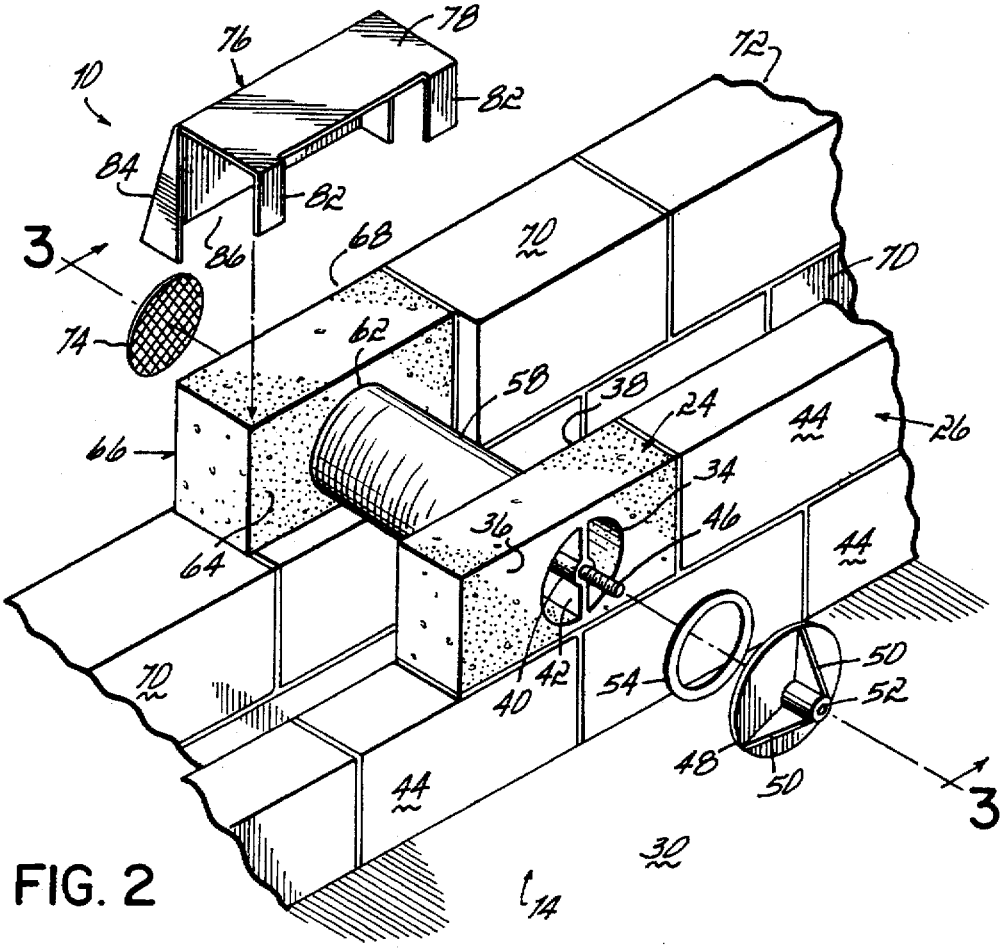
FIG. 2 is an exploded perspective view of the components of the combustion air kit.
Figure 5A:
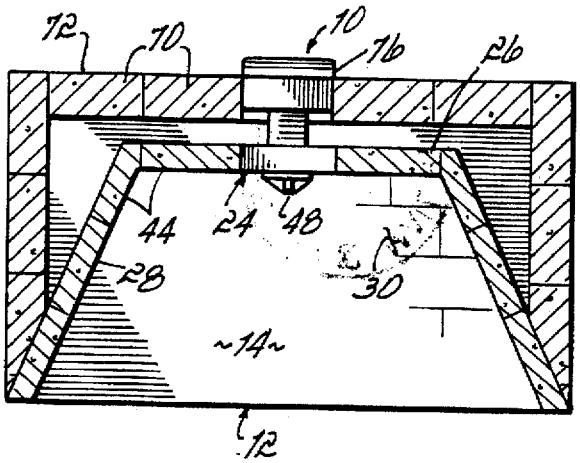
FIGS. 5A–C are cross-sectional top views taken along line 5A–5A of FIG. 1 of alternative configurations for the combustion air kit in communication with the firebox of a fireplace.
Figure 5B:
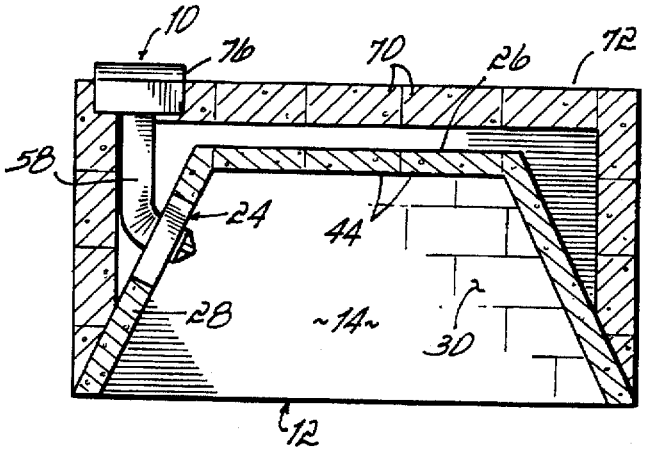
Figure 5C:
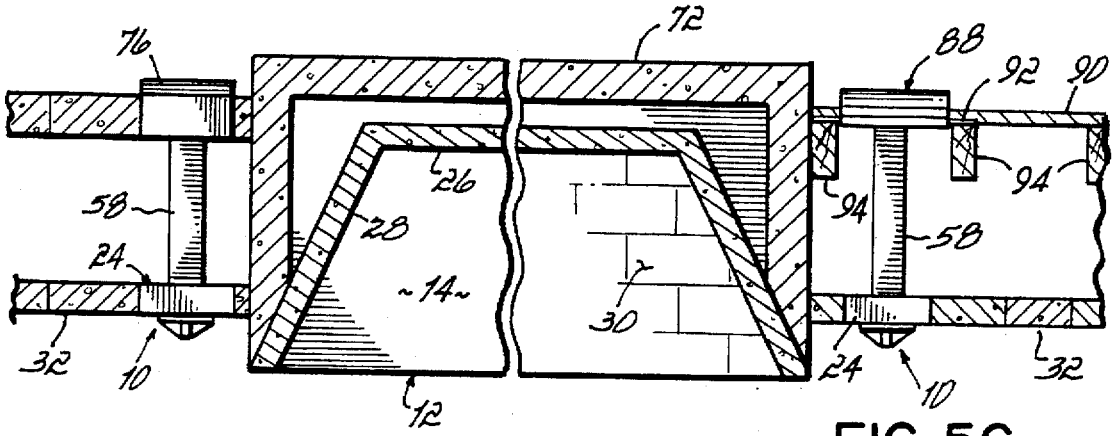

As shown in FIGS. 1–3, the combustion air kit 10 includes a masonry air vent brick 24 located in a wall of the firebox 14. As used herein, the term "wall" refers to any vertical, horizontal, sloped or otherwise oriented surface. Therefore, although the masonry air vent brick 24 is shown in FIGS. 1–3 and 5A in a rear wall, 26 of the firebox 14, it will be appreciated by one of ordinary skill in the art that the air vent brick 24 can readily be located in a side wall 28 of the firebox 14 as shown in FIG. 5B, in a floor 30 of the firebox 14 or in a wall adjacent 32 to the firebox 14 and in communication therewith as shown in FIG. 5C. Moreover, many municipal building codes permit the placement of a fireplace air vent to be on an adjacent wall within a prescribed distance of the firebox, for example at a distance of two feet.

The air vent brick 24 includes a generally circular central hole 34 extending from a front face 36 to a back face 38 of the brick 24. A center plug 40 is located in the hole 34 and is connected to the brick 14 by a pair of webs 42 (FIG. 2). Although the hole 34 is shown in a circular configuration and the plug 40 is supported by a pair of webs 42 in a presently preferred embodiment, it will be appreciated that other configurations of the hole 34 and the web(s) 42 are possible within the scope of this invention.

The air vent brick 24 is preferably fabricated from a fire brick or other high temperature resistant masonry material for use within the firebox 14 as shown in FIGS. 1–3, 5A and 5B. Alternatively, the air vent brick 24 can be fabricated of another masonry component which may offer a more decorative aesthetically pleasing design for use in the wall 32 adjacent the firebox 14 as shown in FIG. 5C. The air vent brick 24 is preferably sized with the same overall outer dimensions as a standard brick 44 used in the wall 26, 28, 30 or 32, typically 4½" high, 9" long and 2¹¹⁄₁₆ thick or an integral number of bricks. With the air vent brick 24 of this configuration, the central hole 34 has a diameter of approximately 3½". However, the size of the brick 24 may vary depending on the application but it is preferred that the respective dimensions of the air vent brick 24 (length and height in particular) be equal to an integral number of bricks 44 which are used to form the wall into which the air vent brick 24 is included. As such, the air vent brick 24 can be easily laid up by the bricklayer or stonemason when building the firebox 14 or other wall without the need for special attention or specialized tools for installing the air vent 24 of the combustion air kit 10 according to this invention.

A threaded post 46 is seated within the center plug 40 and extends forwardly from the front face 36 of the air vent brick 24 as shown particularly in FIG. 2. A circular spinner cap 48 includes vanes 50 on an outer face thereof and a central aperture 52 which is threaded to mate with the threaded post 46 as shown in FIG. 3. Positive rotation of the spinner cap 48 on the post 46 advances the spinner cap 48 into a closed position forming a seal with the air vent brick 24 as shown in FIG. 1. The diameter of the spinner cap 48 is preferably greater than the diameter of the hole 34 in the air vent brick 24 to thereby seal the flow of air through the air vent brick 24. Reverse rotation of the spinner cap 48 on the threaded post 46 retracts the spinner cap from the closed position toward an open position as shown in FIG. 3 thereby permitting the flow of air shown by arrows A through the air vent brick 24. It will be appreciated that the greater the distance between the front face 36 of the air vent brick 24 and the spinner cap 48, the larger the amount of air that is capable of flowing through the air vent brick 24. A high temperature gasket 54 is provided on the spinner cap 48 so that when the spinner cap 48 is in the closed configuration, a positive seal against leaking air is provided. Preferably, the spinner cap 48 is fabricated from cast iron and the vanes 50 provided on the outer surface of the spinner cap 48 provide for easy rotation and manipulation of the cap 48 on the threaded post 46. It will be appreciated that although the post and spinner cap are presently preferred, other configurations or designs for a damper on the air vent are within the scope of this invention.

A first end 56 of a flexible, preferably aluminum, pipe or duct 58 is seated seeded within the hole 34 at the back face 38 of the air vent brick 24. Preferably, the duct 58 is class "O" flex duct. A second end 60 of the duct 58 is seated in a hole 62 in a back face 64 of a vent inlet 66. The flexible duct 58 provides for an unobstructed air flow of the external air to the firebox 14 for linear or non-linear paths between the vent inlet 66 and the air vent 24.

In a presently preferred embodiment, the vent inlet 66 is a masonry brick having the hole 62 therethrough between the back face 64 and a front face 68 of the vent inlet brick 66. Furthermore, the vent inlet brick 66 is preferably sized to be equal to a size of an integral number of bricks 70 which are used to form a wall 72 such as an exterior wall in the house, building or chimney into which the air vent brick 66 is included. Just as with the air vent brick 24, the sizing of the vent inlet brick 66 accommodates easy construction by a bricklayer or stonemason while building the wall 72 without specialized tools or training. Moreover, the vent inlet brick 66 and air vent brick 24 can be easily added to existing fireplaces 12 as a retrofit item by removing the appropriate number of bricks in the wall into which the respective bricks are to be inserted. In one presently preferred embodiment, the vent inlet brick 66 is sized for two modular brick courses in height and one brick in length, typically 5"×7⅝". A screen 74, preferably metal, is inserted into the hole 62 in the vent inlet 66 to prevent animals and other foreign objects from entering the duct 58 and the fireplace 12 through the vent inlet 66.

Another important feature of the combustion air kit 10 is a cover 76 for the vent inlet 66. The cover 76, as particularly shown in FIGS. 2 and 3, includes an upper flange 78 which is juxtaposed between a top of the vent inlet brick 66 and the lower surface of the course of bricks 80 immediately above the vent inlet brick 66. The vent inlet cover 76 is secured in place by the mortar between the vent inlet brick 66 and the immediately super-adjacent course of bricks 80. A pair of tabs 82 project from a rear edge of the upper flange 78 of the cover 76 and are bent downwardly and onto the back face 64 of the vent inlet brick 66 as shown in FIG. 3. One particular advantage of the vent inlet cover 66 according to this design is that the bendable tabs 82 can accommodate variations in the width of the air vent brick 66 because even though the bricks are manufactured to nominal widths of between approximately 2¾" and 4", variations in the manufacturing of the bricks often occur. The ability to deflect the tab 82 downwardly around the vent inlet brick 66 at a number of locations along the length of the tab 82 enables the vent inlet cover 66 according to this invention to be used for a range of sizes of bricks.

Projecting downwardly at an angle from a front edge of the upper flange 78 of the vent inlet cover 66 is a shield 84. The shield 84 provides an aesthetically pleasing cover to the vent inlet 66 and deflects rain, sleet or other falling objects away from the vent inlet 66 while permitting air flow into an open bottom portion 86 of the vent cover 76.

Figure 4:
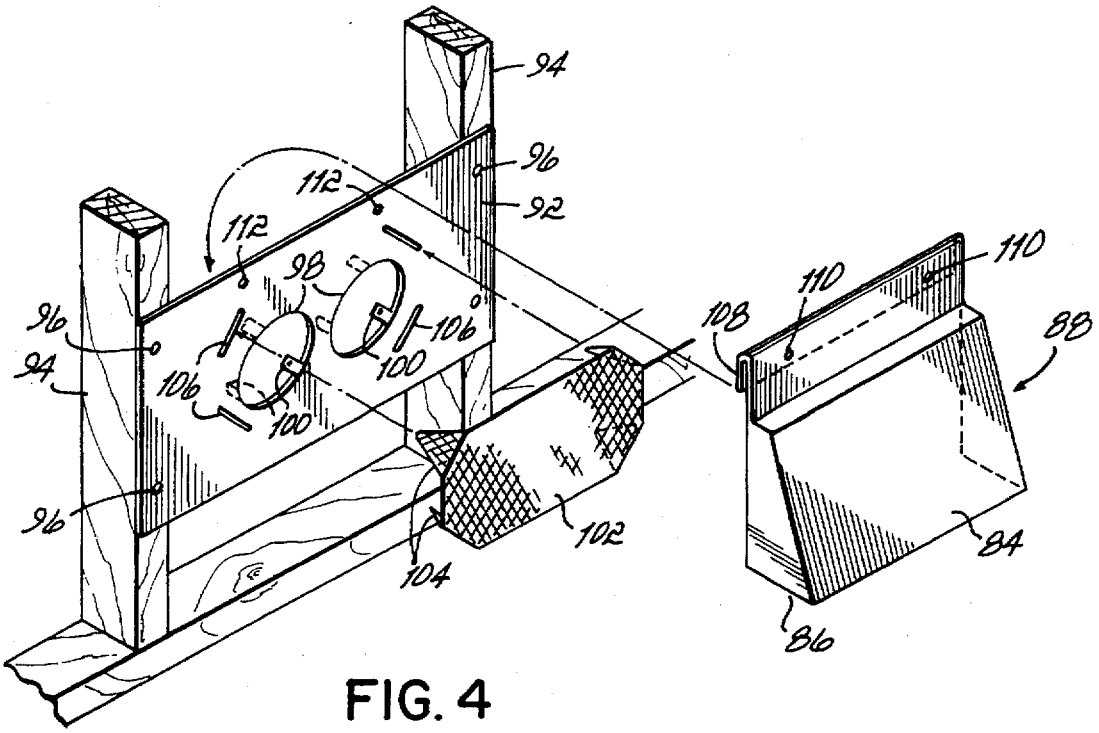
FIG. 4 is an exploded perspective view of the components of an alternate preferred embodiment of the vent inlet cover for use in non-masonry walls.

An alternative embodiment of the vent inlet cover 88 according to this invention is shown in FIG. 4 and the right side of FIG. 5C for use particularly in non-masonry exterior walls 90. In the embodiment shown in FIG. 4, a generally planar plate 92 is attached between two adjacent wall studs 94 which according to standard construction practices are typically spaced on 16" centers. The plate 92 is secured to the adjacent wall studs 94 as with nails, screws or other mechanical fasteners 96. The plate 92 includes one or more holes 98 therein to which the second end of the flexible duct 58 is secured. The embodiment shown in FIG. 4 includes two holes 98 for connection with two separate flexible ducts 58 and associated air vents 24. According to many municipal building codes, fireplaces 12 larger than 42" require more than one external air vent, preferably one on each side of the firebox 14 for adequate air. According to the present invention, a single air vent inlet 66 can be installed to accommodate each of the air vents 24 in communication with the firebox 14 of the fireplace 12. Rearwardly projecting tangs 100 are provided at the perimeter of the holes 98 in the plate 92 to which the flexible duct 58 may be secured as by screws, clips or other fasteners (not shown).

A generally rectangular metal screen 102 is provided to cover the holes 98 on the vent inlet 66. The corners 104 on the metal screen 102 are bent inwardly for insertion into slits 106 in the vent inlet plate 92 to secure the screen 102 in place. The vent inlet cover 88 according to the embodiment shown in FIG. 4 includes an upper hook shaped flange 108 which is hung on the top edge of the vent inlet plate 92. Screws or other mechanical fasteners (not shown) are inserted through holes 110 in the upper flange and through corresponding holes 112 in the vent inlet plate 92 as shown in FIG. 4.

It will be appreciate that the combustion air kit 10 according to this invention provides a passage for external air entering through the opening 86 in the bottom of the vent inlet cover 76 or 88 through the screen 74 or 102 in the vent inlet 66. The external air then passes through the duct 58 and around the plug 40 in the air vent brick 24 and around the spinner cap 48 in an open configuration as shown in FIG. 3 to thereby provide external air for combustion in the fire of the fireplace 12. Moreover, the combustion air kit 10 components are each manufactured from non-combustible materials and are capable of withstanding the high temperature environment associated with the combustion in the firebox 14.

Furthermore, the air vent brick 24 and vent inlet brick 66 in presently preferred embodiments are each masonry components which are sized similar to an integral number of bricks into which the respective components are included for easy installation by a bricklayer or stonemason during the initial construction of the fireplace 12 or during the retrofit of an existing fireplace 12.

From the above disclosure of the general principles of the present invention and the preceding detailed description of a preferred embodiment, those skilled in the art will readily comprehend the various modifications to which this invention is susceptible. Therefore, we desire to be limited only by the scope of the following claims and equivalents thereof.

We claim:

1. A combustion air kit for feeding air from an external source to a firebox, said combustion air kit comprising:

a masonry air vent brick, said air vent brick having a hole therein and being in communication with the firebox;

an adjustable damper on said air vent brick, said adjustable damper being selectively adjustable to and between an open position which permits airflow through said air vent brick hole and a closed position which inhibits airflow to said firebox through said air vent brick;

a duct connected to said air vent brick at a first end, a second end of said duct being in communication with the external source of air to feed the air from the external source to the firebox when said adjustable damper is not in said closed position;

a masonry vent inlet brick on said second end of said duct, said vent inlet brick having an opening connected to said duct, a size of said vent inlet brick being equal to a size of an integral number of bricks which are used to form a wall into which said vent inlet brick is included; a screen covering said opening in said vent inlet brick to inhibit foreign matter from entering said duct;

a cover on said vent inlet brick, said cover having an upper flange for positioning said cover between an upper surface of said vent inlet brick and an immediately super-adjacent brick;

a shield projecting from a front edge of said upper flange to partially cover said opening in said vent inlet brick; and at least one tab projecting from a back edge of said upper flange for attachment of said cover to said vent inlet brick, said tab being deflectable at a number of positions to accommodate a range of thicknesses of said vent inlet brick.

2. A combustion air kit for feeding air from an external source to a firebox, said combustion air kit comprising:

an air vent brick, said air vent brick having a hole therein and being in communication with the firebox;

an adjustable damper on said air vent brick, said adjustable damper being selectively adjustable to and between an open position which permits airflow through said air vent brick hole and a closed position which inhibits airflow to said firebox through said air vent brick;

a duct connected to said air vent brick at a first end, a second end of said duct being in communication with the external source of air to feed the air from the external source to the firebox when said adjustable damper is not in said closed position;

a vent inlet brick on said second end of said duct, said vent inlet brick having an opening connected to said duct, a size of said vent inlet brick being equal to a size of an integral number of bricks which are used to form a wall into which said vent inlet brick is included;

a screen covering said opening in said vent inlet brick to inhibit foreign matter from entering said duct;

a cover on said vent inlet brick, said cover having an upper flange for positioning said cover between an upper surface of said vent inlet brick and an immediately super-adjacent brick;

a shield projecting from a front edge of said upper flange to partially cover said opening in said vent inlet brick; and at least one tab projecting from a back edge of said upper flange for attachment of said cover to said vent inlet brick, said tab being deflectable at a number of positions to accommodate a range of thicknesses of said vent inlet brick.

3. A combustion air kit for feeding air from an external source to a firebox, said combustion air kit comprising:

a masonry air vent brick, said air vent brick having a hole therein and being in communication with the firebox;

an adjustable damper on said air vent brick, said adjustable damper being selectively adjustable to and between an open position which permits airflow through said air vent brick hole and a closed position which inhibits airflow to said firebox through said air vent brick;

a duct connected to said air vent brick at a first end, a second end of said duct being in communication with the external source of air to feed the air from the external source to the firebox when said adjustable damper is not in said closed position;

a masonry vent inlet brick on said second end of said duct, said vent inlet brick having an opening connected to said duct;

a cover on said vent inlet brick, said cover having an upper flange for positioning said cover between an upper surface of said vent inlet brick and an immediately super-adjacent brick;

a shield projecting from a front edge of said upper flange to at least partially cover said opening in said vent inlet brick; and at least one tab projecting from a back edge of said upper flange for attachment of said cover to said vent inlet brick, said tab being deflectable at a number of positions to accommodate a range of thicknesses of said vent inlet brick.

4. A combustion air kit for feeding air from an external source to a firebox, said combustion air kit comprising:

an air vent brick, said air vent brick having a hole therein and being in communication with the firebox;

an adjustable damper on said air vent brick, said adjustable damper being selectively adjustable to and between an open position which permits airflow through said air vent brick hole and a closed position which inhibits airflow to said firebox through said air vent brick;

a duct connected to said air vent brick at a first end, a second end of said duct being in communication with the external source of air to feed the air from the external source to the firebox when said adjustable damper is not in said closed position;

a vent inlet brick on said second end of said duct, said vent inlet brick having an opening connected to said duct; a cover on said vent inlet brick, said cover having an upper flange for positioning said cover between an upper surface of said vent inlet brick and an immediately super-adjacent brick;

a shield projecting from a front edge of said upper flange to at least partially cover said opening in said vent inlet brick; and at least one tab projecting from a back edge of said upper flange for attachment of said cover to said vent inlet brick, said tab being deflectable at a number of positions to accommodate a range of thicknesses of said vent inlet brick.

* * * * *